United States Patent [19]

Gannaway

[11] Patent Number: 4,640,669

[45] Date of Patent: Feb. 3, 1987

[54] ROTARY COMPRESSOR LUBRICATION ARRANGEMENT

[75] Inventor: Edwin L. Gannaway, Adrian, Mich.

[73] Assignee: Tecumseh Products Company, Tecumseh, Mich.

[21] Appl. No.: 837,660

[22] Filed: Mar. 6, 1986

Related U.S. Application Data

[63] Continuation of Ser. No. 670,307, Nov. 13, 1984, abandoned.

[51] Int. Cl.[4] ..... F04B 17/00; F04B 35/04

[52] U.S. Cl. ..... 417/410; 417/902; 184/6.16

[58] Field of Search ..... 417/902, 410, 363, 366, 417/372, 53; 184/6.16, 6.18; 418/97, 94, 88

[56] References Cited

U.S. PATENT DOCUMENTS

| | | | |
|---|---|---|---|
| 2,072,307 | 3/1937 | Kenney . | |
| 2,107,630 | 2/1938 | Erbach . | |
| 2,153,371 | 4/1939 | Hubacker . | |
| 2,212,717 | 8/1940 | Penn . | |
| 2,246,276 | 6/1941 | Davidson . | |
| 2,612,311 | 9/1952 | Warrick et al. . | |
| 2,623,365 | 12/1952 | Daniel . | |
| 2,721,026 | 10/1955 | Dills . | |
| 2,883,101 | 4/1959 | Kosfeld . | |
| 2,988,267 | 6/1961 | Kosfeld . | |
| 3,056,542 | 10/1962 | Galin . | |
| 3,082,937 | 3/1963 | Tucker . | |
| 3,208,667 | 9/1965 | Boettcher . | |
| 3,250,459 | 5/1966 | Brown et al. . | |
| 3,499,600 | 3/1970 | McGregor . | |
| 3,513,476 | 5/1970 | Monden et al. . | |
| 3,565,552 | 2/1971 | Mondem et al. | 417/372 |
| 3,804,202 | 4/1974 | Funke . | |
| 3,813,193 | 5/1974 | Rinehart . | |
| 4,391,573 | 7/1983 | Tanaka et al. . | |

FOREIGN PATENT DOCUMENTS

| | | | |
|---|---|---|---|
| 20765 | 5/1956 | Fed. Rep. of Germany | 417/372 |
| 1379368 | 10/1964 | France . | |
| 145294 | 11/1980 | Japan . | |
| 59-170486 | 9/1984 | Japan . | |
| 300662 | 11/1972 | U.S.S.R. . | |

*Primary Examiner*—Carlton R. Croyle
*Assistant Examiner*—Donald E. Stout
*Attorney, Agent, or Firm*—Anthony Niewyk; Albert L. Jeffers

[57] ABSTRACT

In a rotary hermetic compressor an improved lubrication arrangement is provided for the sliding cylinder vanes. An oil pump in the lower portion of the crankshaft extends into the oil sump of the compressor. The oil pump comprises an axial aperture in the crankshaft which angles diagonally radially outwardly in the upward direction. Oil is pumped through this aperture into an annulus surrounding the crankshaft. A passageway in the outboard bearing conducts the oil radially outwardly from the annulus and then upwardly against gravity to a vertical oil channel which is open to both sides of the sliding vane and adjacent thereto. The positive pressure provided by the oil pump will ensure that the oil channel is filled with oil at all times. Excess oil exits at the upper end of the vane through a relief in the main bearing and then flows down around the cylinder by gravity and into the oil sump.

10 Claims, 7 Drawing Figures

ROTARY COMPRESSOR LUBRICATION ARRANGEMENT

This is a continuation of application Ser. No. 670,307, filed Nov. 13, 1984, now abandoned.

BACKGROUND OF THE INVENTION

This invention pertains to hermetic rotary compressors for compressing refrigerant in refrigeration systems such as refrigerators, freezers, air conditioners and the like. In particular, this invention relates to the manner of lubricating the sliding vanes in a rotary compressor.

In general, prior art rotary hermetic compressors comprise a housing in which are positioned a motor and a compressor cylinder. The motor drives a crankshaft having an eccentric portion thereon for revolving inside a bore which is located centrally in the compressor cylinder. The eccentric has a roller rotatably mounted thereon which revolves within the bore as the crankshaft rotates. One or more sliding vanes which are slidably received in slots located in the cylinder wall cooperate with the roller to provide the pumping action for compressing refrigerant within the cylinder bore.

The operating parts of rotary hermetic compressors are machined to extremely close tolerances and the surfaces of the parts are finished to a high degree in order to prevent leakage in the compressor and to provide a very efficient compressor. It is important to properly lubricate the operating parts to preserve the surface finish. Additionally, it is important that proper lubrication be provided for the moving parts of the compressor so that dynamic friction is kept low and frictional losses are minimized. Lastly, by providing adequate lubrication a minimum amount of heat due to friction losses is generated, heat transfer is reduced and the compressor efficiency is improved.

Many types of lubrication arrangements have been provided in the prior art rotary hermetic compressors. Generally, in the prior art arrangements some type of pumping mechanism pumps oil upwardly from an oil sump located in a lower portion of the compressor and distributes the oil to the locations requiring lubrication. The oil is generally slung outwardly to the upper parts of the compressor by means of centrifugal force and is then allowed to drip downwardly by gravity to lubricate the desired portions of the compressor. Excess oil then returns to the oil sump by means of gravity.

Some examples of prior art lubrication arrangements using centrifugal and gravity distribution forces are shown in U.S. Pat. Nos. 3,804,202; 2,623,365; 2,883,101; 2,246,276; and 3,802,937.

One of the problems encountered in prior art hermetic compressor lubrication arrangements has been that insufficient oil reaches the critical areas of the compressor. By relying on the force of gravity or the outward centrifugal slinging of lubricant it is possible that the moving parts in critical areas of the compressor do not receive sufficient oil and are, therefore, not properly lubricated. In particular, the sliding vane surfaces of the compressor should be well lubricated because of the continuous vane loads which minimizes the time for oiling in the vane slot clearances of the compressor cylinder. A more accessible oil supply facilitates lubrication and minimizes vane wear. Furthermore, since both sides of the sliding vane should be well lubricated it is desirable that the lubricating arrangement provides sufficient lubricant to both sides of the sliding vane.

Another problem which has been encountered in prior art compressors is leakage of refrigerant from the high pressure to the low pressure side of the vane. The sliding vane of a rotary compressor divides the low pressure area in the bore of the compressor from the high pressure area in the bore and refrigerant will therefore tend to leak around the sides, top and bottom of the vane from the high pressure side to the low pressure side. Since leakage of compressed refrigerant represents lost work leakage decreases the efficiency of the compressor. It is, therefore, desirable to provide proper lubrication for both sides of the vane to thereby create an oil film on both sides of the compressor vane which forms a hydraulic seal for the sliding vane in the vane slot of the cylinder wall. The oil seal will then block refrigerant leakage around the vane.

Yet another problem which has been encountered in the prior art hermetic rotary compressors is that the lubricant oil is not provided under positive pressure to the areas to be lubricated so that the oil passages for delivering oil to those areas are not always filled with oil. Because of this deficiency it is possible that there will be a lack of adequate lubricant quantities for proper lubrication. It is, therefore, desirable that oil is delivered under positive pressure to the areas to be lubricated so that a sufficient supply of oil is available at all times. It is also desirable that the lubricating oil is delivered under positive pressure so that the oil reaches every portion of the area to be lubricated.

SUMMARY OF THE INVENTION

The present invention overcomes the disadvantages of the above-described prior art rotary hermetic compressors by providing an improved lubrication arrangement for a rotary compressor.

According to one form of the present invention a lubricating arrangement for a rotary hermetic compressor is provided wherein an oil pump provides oil under positive pressure to both sides of the sliding vane and wherein the excess oil returns to the sump by means of gravity.

The present invention according to one form thereof, comprises a lubrication arrangement in a rotary hermetic compressor wherein an oil pump which is located in the lower portion of the crankshaft extends into the oil sump of the compressor. The oil pump comprises an axial aperture in the lower portion of the crankshaft which angles diagonally radially outwardly in an upward direction. Oil is pumped through this aperture into an annular chamber surrounding the crankshaft. A passageway in the outboard bearing of the compressor communicates with this annular chamber and conducts the oil radially outwardly from the annulus and then upwardly against gravity under positive pressure into a pair of vertical oil channels which are located adjacent the vane and are open to both sides of the vane. The positive pressure provided by the oil pump ensures that the oil channels are filled with oil at all times. Excess oil exits at the upper end of the vane through a relief in the main bearing and flows down around the cylinder by gravity and into the oil sump.

One advantage of the lubrication system of the present invention is that adequate quantities of lubricating oil are supplied at all times to the vane of the compressor.

Another advantage according to the present invention is that the lubricating oil is supplied to the sliding vane of the compressor under positive pressure so that the vane is properly lubricated regardless of the oil level in the sump.

Yet another advantage according to the present invention is the provision of a lubricating arrangement for the sliding vane of a rotary hermetic compressor wherein the oil forms a hydraulic seal around the vane of the compressor.

Still another advantage according to the present invention is the provision of lubricating passages which are filled adjacent the sliding vane of a compressor so that a sufficient quantity of oil is available for lubricating the vane at the point of heaviest load at all times.

A further advantage of the structure according to the present invention is that frictional losses in the compressor are kept to a minimum by means of proper lubrication and the efficiency is improved.

A yet further advantage according to the structure of the present invention is that a minimum amount of heat due to frictional losses is generated, heat transfer is minimized and the compressor efficiency is improved.

It is a still further advantage of the structure of the present invention that vane wear is minimized because of proper lubrication of the compressor vane.

The invention comprises, in accordance with one form thereof, a rotary compressor including a crankshaft rotatably journalled in a bearing and a sliding vane, the vane having at least two sliding surfaces. A lubricating means is provided for lubricating the vane and comprises an oil sump located in a lower portion of the housing, and an oil pumping means communicating with the sump for pumping oil upwardly from the sump. Means as provided for conducting oil from the oil pumping means under positive pressure to a lubrication passage located adjacent the vane for lubricating both sliding surfaces of the vane.

Still further, in accordance with one form thereof, the invention comprises a rotary compressor having a rotor including a shaft rotatably journalled in a bearing and a compressor cylinder coaxial with the bearing. The cylinder has a vane slot in the cylindrical wall thereof and a vane having at least two sliding surfaces is slidably received in the slot. Lubrication means for supplying lubricating oil to the vane comprises an oil sump in the bottom of the housing, oil pump means in the crankshaft for pumping oil upwardly and an oil passageway in the bearing. The passageway conducts oil radially outwardly from the crankshaft pump means under positive pressure to vane lubrication means located in the cylinder for lubricating both sliding surfaces of the vane.

The invention further provides, in accordance with one form thereof, a hermetic rotary compressor for compressing refrigerant including a housing, an electric motor for driving the compressor and a crankshaft driven by a motor. The crankshaft is journalled in first and second bearings and a cylinder is located intermediate to bearings and is coaxial therewith. A vane slot is located in the wall of the cylinder and the vane is slidably received in the slot. An oil lubrication means for lubricating the vane comprises an oil sump located in the housing and an oil pump means in the crankshaft for pumping oil upwardly from the sump. The pump means comprises an axial aperture in the crankshaft the aperture extending axially upwardly and diagonally outwardly from the crankshaft axis. The upper portion of the axial aperture communicates with the radial passage in the crankshaft for conducting oil to an annular chamber surrounding the crankshaft. A passageway in the first bearing conducts oil from the annular chamber to the vane under positive pressure. At least one oil channel extends through the cylinder, the axis of the channel being parallel to the crankshaft axis and the channel communicating with both the slot and the first bearing passageway.

It is an object of the present invention to provide a lubrication system for positively lubricating the sliding vane of a rotary hermetic compressor.

It is another object of the present invention to provide an oil lubricating system for a rotary hermetic compressor wherein oil is provided under positive pressure to the area of the compressor requiring lubrication and wherein oil returns to the sump by gravity.

It is yet another object of the present invention to provide an oil lubricating system in a rotary hermetic compressor wherein an oil channel is provided adjacent to and communicating with the vane and the vane slot whereby oil is pumped from the oil sump and conducted to the oil channel under positive pressure to lubricate the vane.

Still another object of the present invention is to provide an oil lubricating system for a hermetic rotary compressor wherein the vane lubricant forms a hydraulic seal for the vane whereby leakage of refrigerant is reduced.

DESCRIPTION OF THE PREFERRED EMBODIMENT

Figure 1:
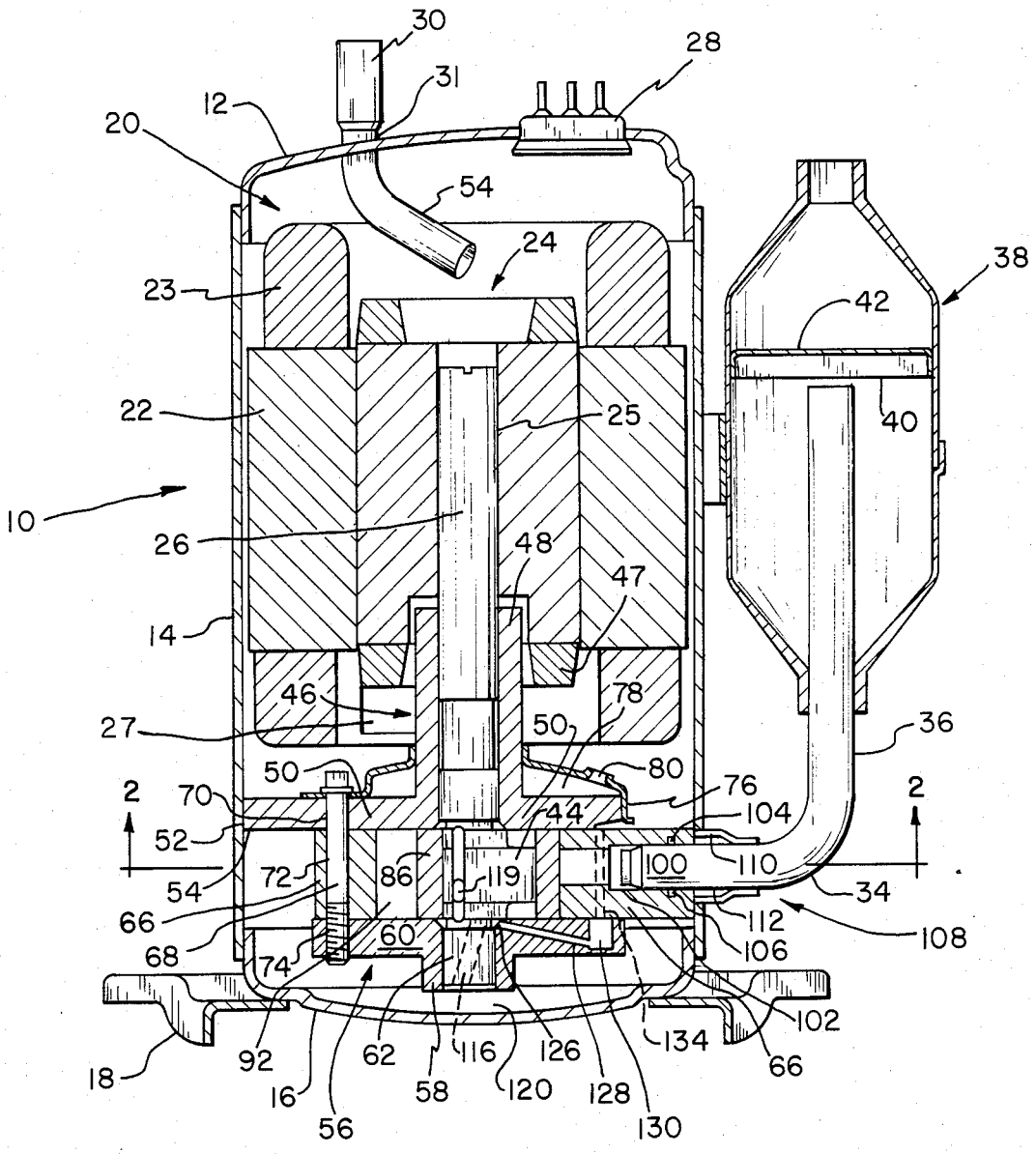
FIG. 1 is a side sectional view of the compressor.

In an exemplary embodiment of the invention as shown in the drawings, and in particular by referring to FIG. 1, a compressor is shown having a housing generally designated at 10. The housing has a top portion 12, a lower portion 16 and a central portion 14. The three housing portions are hermetically secured together as by welding or brazing. A flange 18 is welded to the bottom of housing 10 for mounting the compressor. Located inside the hermetically sealed housing is a motor generally designated at 20 having a stator 22 and a rotor 24. The stator is provided with windings 23. The stator is secured to the housing 10 by an interference fit such as by shrink fitting. The rotor 24 has a central aperture 25 provided therein into which is secured a crankshaft 26 by an interference fit. A terminal cluster 28 is provided on the top portion 12 of the compressor for connecting the compressor to a source of electric power.

A refrigerant discharge tube 30 extends through top portion 12 of the housing and has an end 32 thereof extending into the interior of the compressor as shown. The tube is sealingly connected to housing 10 at 31 as by soldering. Similarly, a suction tube 34 extends into the interior of compressor housing 10 and is sealed thereto as further described hereinbelow. The outer end 36 of suction tube 34 is connected to accumulator 38 which has support plates 40 disposed therein for supporting a filtering mesh 42.

Figures 5, 6:
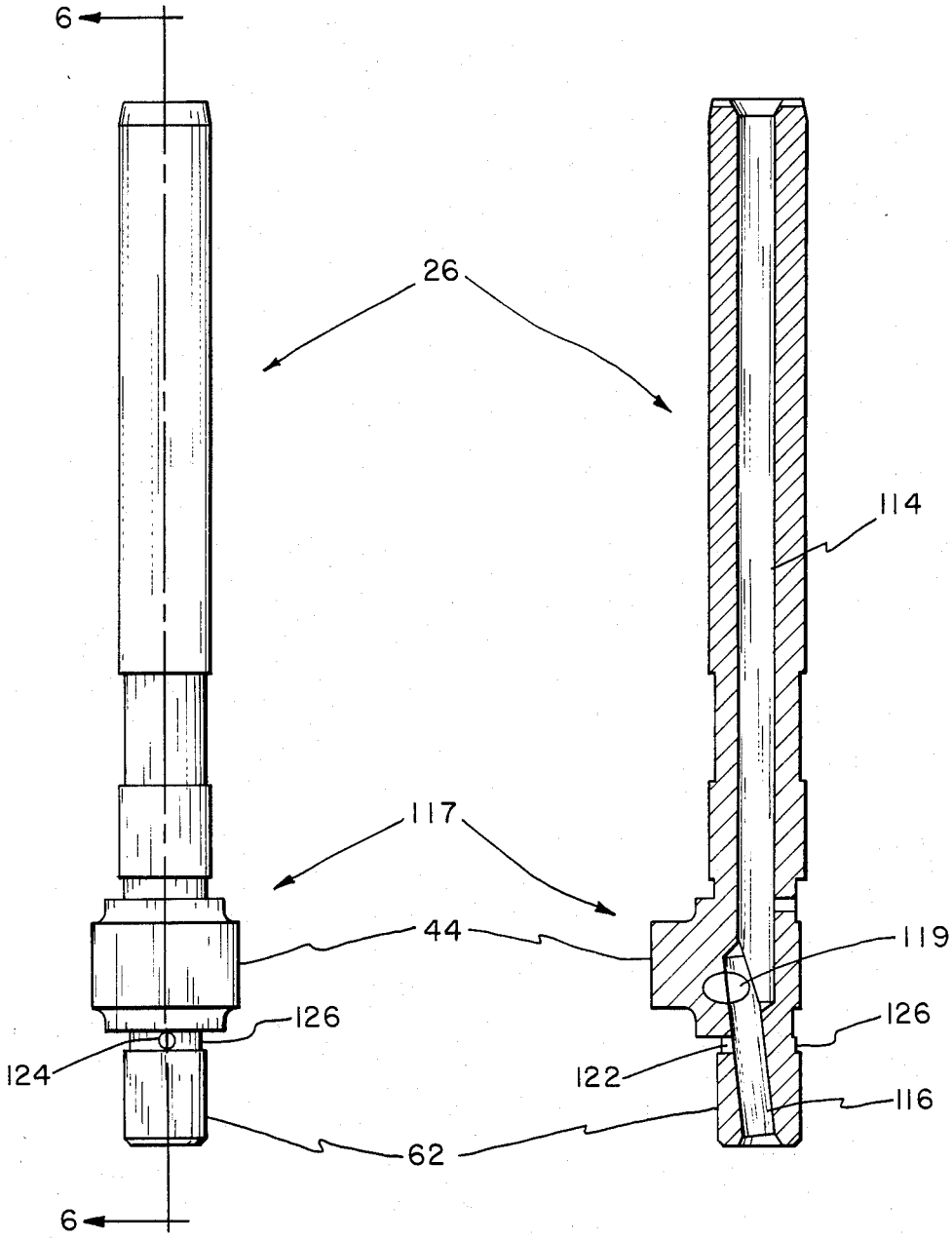
FIG. 5 is a side elevational view of the crankshaft.
FIG. 6 is a sectional view of the crankshaft taken along the line 6—6 of FIG. 5.

By referring specifically to FIGS. 1, 5 and 6, it can be seen that crankshaft 26 is provided with an eccentric portion 44 which revolves around the crankshaft axis as crankshaft 26 is rotatably driven by rotor 24. A counterweight 27 is provided to balance eccentric 44 and is secured to the end ring 47 of rotor 24 by riveting. Crankshaft 26 is journalled in a main bearing 46 having a cylindrical journal portion 48 and a generally flat planar mounting portion 50. Planar portion 50 is secured to housing 10 at three points 52 such as by welding of flanges 54 to the housing as best illustrated in FIG. 2.

Figure 4:
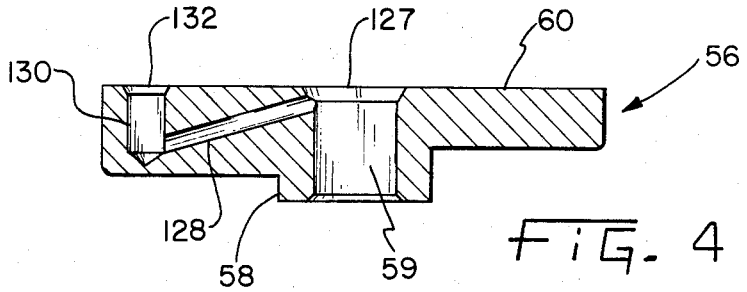
FIG. 4 is a side sectional view of the lower bearing taken along the line 4—4 of FIG. 3.
Figure 3:
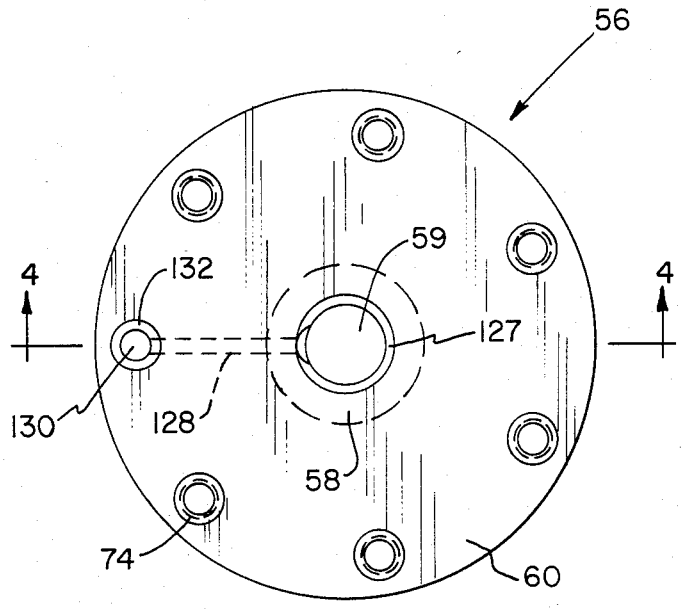
FIG. 3 is a plan view of the lower bearing.

A second bearing or journal 56 sometimes referred to as the outboard bearing, is also shown disposed in the lower part of housing 10. As best illustrated in FIGS. 3 and 4, lower bearing 56 is provided with a journalling portion 58 having aperture 59 therein and a generally planar portion 60. Crankshaft 26 has a lower portion 62 journalled in journalling portion 58 of outboard bearing 56 as illustrated in FIG. 1.

Located intermediate main bearing 46 and outboard bearing 56 is a compressor cylinder 66. Compressor cylinder 66, outboard bearing 56 and main bearing 46 are secured together by means of six bolts 68, one of which is indicated in FIG. 1. By referring to FIG. 2, it can be seen that six holes 70 are provided in cylinder 66 for securing bearings 46,56 and cylinder 66 together. Bolts 68 extend through holes 70 in main bearing 46, holes 72 in cylinder 66 and into threaded holes 74 in lower bearing 56. If the cylinder axial dimension is sufficiently large the six bolts 68 could be replaced with twelve bolts, six of which would secure outboard bearing 56 to cylinder 66 and be threaded into cylinder 66. The remaining six bolts would secure main bearing 46 to the cylinder 66 and be threaded into cylinder 66. A discharge muffler 76 is also secured to main bearing 46 by bolts 68 as indicated in FIG. 1. Compressed refrigerant gas is discharged through relief 64 into discharge space 78 defined by discharge muffler 76 and the top surface of planar bearing portion 50. From space 78 the refrigerant will exit into housing 10 through three openings 80 in muffler 76, one of which is indicated in FIG. 1.

Figure 2:
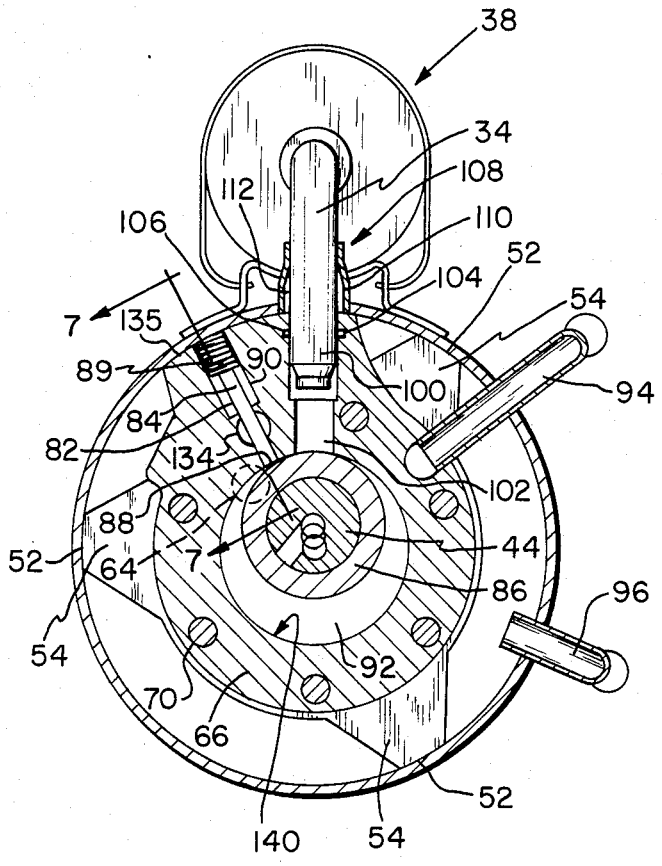
FIG. 2 is a sectional view of the compressor taken along the line 2—2 of FIG. 1.

By referring to FIG. 2 it can be seen that cylinder 66 has a vane slot 82 provided in the cylindrical wall thereof into which is received a sliding vane 84. Roller 86 is provided which surrounds eccentric portion 44 of crankshaft 26 and revolves around the axis of crankshaft 26 and is driven by eccentric 44. Tip 88 of sliding vane 84 is in continuous engagement with roller 86 as vane 84 is urged against the roller by spring 89 received in spring pocket 90. By referring to FIG. 2, it can be seen that, in operation, as the roller 86 revolves around bore 92, the compression volume enclosed by roller 86, bore 92 and sliding vane 84 will decrease in size as roller 86 revolves clockwise around bore 92. Refrigerant contained in that volume will therefore be compressed and after compression will exit through relief 64 in the cylinder as explained hereinabove. A discharge valve (not shown) located in main bearing 46 discharges refrigerant into discharge volume 78 defined by discharge muffler 76 and planar portion 50 of main bearing 46. The compressed refrigerant will exit from discharge muffler 76 through three discharge openings 80 in muffler 76 into sealed housing 10 of the compressor. The refrigerant is discharged directly into motor windings 23 whereby the windings will be cooled.

As shown in FIG. 2, tubes 94 and 96 exit from the compressor housing and are connected to a desuperheater (not shown) as is well known in the prior art. Suction tube 34 extends into housing 10 and is sealed thereto as best illustrated in FIG. 1. Suction tube 34 has a portion 100 extending into an aperture 102 in the wall of cylinder 66. Aperture 102 extends completely through the cylinder wall and communicates with bore 92 as best shown in FIG. 2. Tube 34 is sealed to aperture 102 by means of an O-ring 104 housed in an annular recess 106 of the cylinder wall of cylinder 66. A cylindrical soldering flange 108 secures tube 34 to housing 10 and conducts heat away from the tube 34 as it is being soldered to the housing. Portion 110 extends away from tube 34 and is spaced from tube 34 by a space 112 extending between portion 110 and tube 34. Portion 110 conducts heat away from tube 34 and into housing 10.

As best illustrated in FIGS. 5 and 6, crankshaft 26 is provided with an axial aperture 114 which extends completely through the upper portion of the crankshaft as shown. An aperture 116 extends the entire length of the lower portion 117 of the crankshaft 26 as shown and communicates with aperture 114. The extreme lower end 62 of crankshaft 26, which is journalled in outboard bearing 56 extends into oil sump 120 located in housing lower shell portion 16. It should be noted that aperture 116 diverges radially outwardly of the crankshaft axis in the upward direction so that it angles diagonally upwardly and its upper portion is spaced radially further outwardly from the crankshaft axis than its lower portion. As oil is drawn up into aperture 116 by the rotating movement of crankshaft 26, the oil is spun outwardly by centrifugal force due to the diagonal orientation of aperture 116. Oil under positive pressure will be provided by aperture 116 to opening 119 in crankshaft 26 to lubricate roller 86. A radial passageway 122 includes an outer opening 124 which extends into an annular space 126 surrounding crankshaft 26. Annulus 126 surrounding crankshaft 26 provides a chamber together with relief 127 in outboard bearing 56 for the oil to flow into under positive pressure from the pumping aperture 116. The oil will flow outwardly under positive pressure from annular chamber 126 through passageway 128 as best illustrated in FIG. 4. Passageway 128 extends radially outwardly in outboard bearing 56 and conducts oil to an upwardly extending passageway 130. Passageway 130 has a relief 132 formed therein which abuts cylinder 66.

As best shown in FIG. 1, passageway 130 conducts oil under positive pressure upwardly into a pair of grooves or channels 134 formed on either side of vane slot 82 in the wall of cylinder 66. Channels 134 are located closer to bore 92 than to the outside wall 135 of cylinder 66. Oil will be supplied at positive pressure to oil channels 134 and will fill those channels completely at all times thereby allowing vane 84 to be well lubricated. Channels 134 are adjacent to and have one side completely open to slot 82. The column of oil in channels 134 surrounding the vane will prevent refrigerant gas under discharge pressure to escape from the sealed housing enclosure through vane slot 82 since the oil in channels 134 forms a hydraulic seal in combination with the vane 84.

Figure 7:
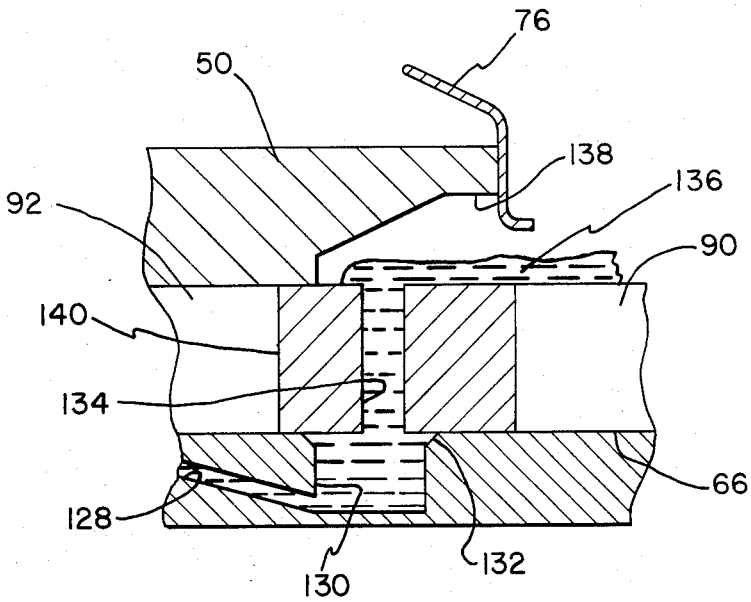
FIG. 7 is a broken-away sectional view taken along the lines 7—7 of FIG. 2.

By referring to FIG. 7 an enlarged broken-away sectional view of one of the oil channels as viewed from line 7—7 in FIG. 2 can be seen. In cross section oil channels 134 in the cylinder wall of cylinder 36 are semicircular as best shown in FIGS. 2 and 7. The channels or grooves 134 are located adjacent slots 82 and are open to the slot on one side along their entire axis. Oil can therefore freely contact both sides of vane 84. FIG. 7 also shows spring pocket 90 and planar portion 60 of lower bearing 56 which has a passageway 128 therein from which oil flows into upwardly extending passageway 130. It can be seen that oil will flow upwardly from passage 130 past relief 132 directly into the oil channels 134 from where the oil 136 will exit onto the top of cylinder 66 as shown into the relief portion 138 of main bearing 46. The inner wall of cylinder 66 defining the bore 92 is also shown at 140. By placing channels 134 closer to bore 92 than to the outside of the cylinder wall the oil positively lubricates the vane portion adjacent to the bore and, therefore, supplies oil at the point of heaviest load. Since the refrigerant tends to leak from the high pressure portion of the housing into the low pressure side of the cylinder bore, the location of the channels closely adjacent the bore is desirable to maintain an adequate oil seal in the leakage clearance. Oil channels 134 are substantially perpendicular to the direction of movement of vane 82. From relief 138 the oil will flow outwardly and drip downwardly around the cylinder and the lower bearing 56 back into the sump 120.

What has therefore been disclosed is a rotary hermetic compressor wherein oil is pumped from an oil sump and conducted by positive pressure through a radial passageway in the outboard bearing and upwardly axially into a pair of oil channels formed adjacent the vane slot. The oil channels will be continuously filled with oil under the positive pressure from the pumping mechanism, thereby providing proper lubrication of the vane as well as hydraulic sealing to prevent refrigerant gas from leaking past the vane. By properly lubricating the vane, its surface temperature will be minimized. The combination of proper lubrication under positive pressure and hydraulic sealing increases the efficiency of the compressor because of a reduction in leakage and the reduction in the heat exchange which takes place in the compressor.

While this invention has been described as having a preferred design, it will be understood that it is capable of further modification. This application is therefore intended to cover any variations, uses, or adaptations of the invention following the general principles thereof and including such departures from the present disclosure as come within known or customary practice in the art to which this invention pertains and fall within the limits of the appended claims.

What is claimed is:

1. In a rotary compressor including a vertical crankshaft rotatably journalled in a bearing, a compressor cylinder including a vane slot in a wall of said cylinder and a sliding vane slidably received in said vane slot for compressing a compressible gas, said vane having at least two sliding surfaces, lubrication means for lubricating said vane comprising:

an oil sump located in a lower portion of said housing;

oil pumping means comprising an axial passageway in said crankshaft, said passageway communicating with said oil sump for pumping oil upwardly from said sump;

an upwardly extending lubrication passage in said cylinder, said passage being open to said vane slot;

duct means directly connecting said lubrication passage to said axial passageway for supplying oil upwardly under positive pressure against gravity from said axial passageway to said lubrication passage for lubricating said at least two sliding surfaces of said vane.

2. The lubrication means according to claim 1 wherein said oil conducting means comprises a radial passageway means in said bearing for conducting oil from said pumping means to said lubrication passages.

3. The compressor according to claim 1 wherein the upper end of said lubrication passage is open to the top surface of said cylinder, whereby excess oil exits from said lubrication passage to the top surface of said cylinder and returns to said sump by gravity.

4. The lubrication means of claim 1 wherein said oil pum means comprises an axial aperture in said crankshaft, said aperture communicating with said sump, said aperture diverging radially outwardly from said crandshaft axis in the upward direction whereby the upper end of said aperture is positioned radially outwardly from the lower end of said aperture.

5. The compressor according to claim 1 wherein said lubrication passage means comprises a pair of elongated recesses respectively located in said cylinder wall on opposite sides of said vane slot, said recesses each being open to said vane slot along their respective one elongated sides to form elongated depressions in the side walls of said vanes slot.

6. The lubrication means of claim 5 wherein each said recesses comprises channel means having a semi-circular cross section, said channels each being open along substantially their entire length to said vane slot.

7. The compressor according to claim 5 wherein said cylinder includes a bore and said vane slot communicates with said bore, said recesses being located intermediate said bore and the outside circumferential surface of said cylinder wall and closer to said bore than said outside wall surface.

8. In a hermetic rotary compressor for compressing refrigerant including a housing, an electric motor for driving said compressor, a crankshaft driven by said motor, said crankshaft journalled in a bearing, a cylinder adjacent to said bearing said coaxial therewith, a vane slot in the wall of said cylinder and a vane slidably received in said slot, oil lubrication means for lubricating said vane comprising:

an oil sump located in said housing;

oil pump means in said crankshaft for pumping oil upwardly from said sump, said pump means comprising an axial aperture in said crankshaft, said aperture extending axially upwardly and radially outwardly from said crankshaft axis;

the upper portion of said axial aperture communicating with a radial passage in said crankshaft for conducting oil to an annular chamber surrounding said crankshaft;

a passageway in said bearing for conducting said oil from said annular chamber upwardly to said vane under positive pressure;

at least one elongated oil channel extending through said cylinder, said channel being axially parallel to said crankshaft axis and the channel being open to said slot along its entire length and having one end open to said bearing passageway and its other end open to the upper surface of said cylinder for supplying lubricating oil to said vane under positive pressure of said oil pump means.

9. The lubrication means of claim 8 wherein said oil is conducted through said bearing radially outwardly and axially upwardly into said oil channel.

10. The lubrication means of claim 8 wherein said lubricating oil in said vane slot forms a hydraulic seal to prevent leakage of refrigerant through said vane slot.

* * * * *